United States Patent [19]

Dunham

[11] Patent Number: 5,051,667

[45] Date of Patent: Sep. 24, 1991

[54] ARC INTERRUPTING LAMP BALLAST

[75] Inventor: Richard M. Dunham, Salisbury, N.H.

[73] Assignee: Walker Power, Inc., Warner, N.H.

[21] Appl. No.: 469,261

[22] Filed: Jan. 24, 1990

[51] Int. Cl.[5] ..... H05B 41/36

[52] U.S. Cl. ..... 315/307; 315/219; 315/DIG. 7

[58] Field of Search ..... 315/307, 224, 209 R, 315/219, DIG. 7; 361/42, 44, 45

[56] References Cited

U.S. PATENT DOCUMENTS

| | | | |
|---|---|---|---|
| 3,611,102 | 10/1971 | Wallace | 315/239 |
| 4,700,113 | 10/1987 | Stupp | 315/307 |
| 4,719,390 | 1/1988 | Saivanen | 315/307 |
| 4,855,860 | 8/1989 | Nilssen | 361/45 |
| 4,904,903 | 2/1990 | Pacholok | 315/307 |
| 4,914,356 | 4/1990 | Cockram | 315/307 |
| 4,952,849 | 8/1990 | Fellows | 315/307 |

FOREIGN PATENT DOCUMENTS

| | | |
|---|---|---|
| 2068656 | 8/1981 | United Kingdom . |
| 2211636 | 7/1989 | United Kingdom . |

*Primary Examiner*—Eugene R. Laroche
*Assistant Examiner*—A. Zarabian
*Attorney, Agent, or Firm*—Henry D. Pahl, Jr.

[57] ABSTRACT

The lamp ballasting apparatus disclosed herein is of the high-frequency switching type which operates from a DC supply and effects pulse-width modulation to control the level of energization of the lamp. A common mode choke interposed between the lamp and the modulating means provides a series inductance opposing rapid common mode changes in the currents flowing through the lamp leads. A fast semiconductor switch is interposed in the lamp circuit. A current transformer inductively linked to the lamp leads generates a control signal having an amplitude which is a function of the difference of the current flowing in the leads and this control signal operates the switch when the current difference rises above a preselected level indicating an arcing condition.

7 Claims, 3 Drawing Sheets

ARC INTERRUPTING LAMP BALLAST

BACKGROUND OF THE INVENTION

The present invention relates to ballasting apparatus of the type generally employed with arc or gas-discharge type lamps and more particularly to such apparatus which protects against excessive arcing and overheating.

As is understood by those skilled in the art, most arc and gas-discharge type lamps require ballasting of one sort or another, typically due to the negative resistance characteristics of the discharges. Further, such lamps typically require the application of relatively high voltages for starting, i.e., voltages which are orders of magnitude greater than the voltages required during continuous operation. As is also understood, these high starting voltages, though momentary, can initiate an arc-over between the lamp leads and ground.

The most commonly used type of ballast apparatus uses a magnetic reactor to limit the lamp current as well as to limit any arc-over current. Magnetic reactors are, for example, typically employed for common fluorescent lamp ballasts. Mass produced, these ballasts are relatively inexpensive, but are quite heavy and are a source of heat. Further, if a short circuit occurs, the ballasts can overheat and bake, eventually failing entirely.

Magnetic reactance type ballasts have also been used with many other types of lamps. However, as lamp power goes up, so does the size and weight of the magnetic ballast. Further, with more powerful lamps, e.g., sodium vapor lamps, higher starting voltages are needed and extra insulation or air-space must be used around the wires, connectors and sockets to avoid the creation of an arc to the chassis or safety ground. Conventionally, arc-over must be avoided for two reasons. One, if the high voltage is not impressed on the lamp long enough, the lamp may not start. Secondly, the current in an arc-over can reach hundreds of amperes very quickly. It is thus essential to limit arc-over currents to a safe level in order to avoid a fire hazard. A circuit breaker or fuse may be a minimum acceptable protection but is only acceptable if the user does not mind resetting the breaker or replacing the fuse. A large magnetic reactor in series with the lamp's power leads will limit current in one sense but will also tend to maintain rather than cut-off the current during arcing.

More recently, so-called switcher type ballasts have been devised to alleviate the weight and overheating problems experienced with magnetic ballast used with high-power lamps. However, since the switcher type ballast does not conventionally employ a large series reactance to limit lamp current, an arc-over can quickly create destructively high currents. To avoid such currents, it has been a common practice to incorporate an isolation transformer which can block arc-over currents to ground but can pass the normal lamp current. Such isolation transformers may be of the line frequency type, i.e., located at the input of the ballast or a high frequency type which is within the ballast itself. An input transformer must pass the full lamp power at low frequency. Such transformers tend to be large and heavy. The high frequency types may be made smaller and lighter than line frequency transformers but are expensive and still are large in comparison with the typical high frequency transformers since the characteristics of the lamps require both high voltage and high current, resulting in a need for a lot of large wire in the transformer structure.

Among the several objects of the present invention may be noted the provision of novel ballasting apparatus for discharge lamps; the provision of such apparatus which controls arc-over currents; the provision of such apparatus which controls lamp power; the provision of such apparatus which does not require the use of an isolation transformer; the provision of such apparatus which minimizes heating; the provision of such apparatus which is highly efficient and which is of relatively simple and inexpensive construction. Other objects and features will be in part apparent and in part pointed out hereinafter.

SUMMARY OF THE INVENTION

The apparatus of the present invention is effective to operate a lamp of the type which is energized through a pair of leads and which requires ballasting. A power supply generates DC voltage at a level suitable for energizing the lamp and current flow to the lamp from the power supply is pulse width modulated at relatively high frequency as a function of the power drawn by the lamp. A common mode choke between the supply and the lamp includes a pair of matched windings connected to the lamp leads to provide a series inductance opposing rapid common-mode changes in the currents flowing through the leads. A winding inductively linked to the currents flowing in the leads generates a control signal having an amplitude which is a function of any difference in the currents flowing in the leads and this control signal is employed to operate a switch which selectively interrupts current flowing to the lamp when the current difference in the leads rises above a preselected level indicating an arcing condition.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
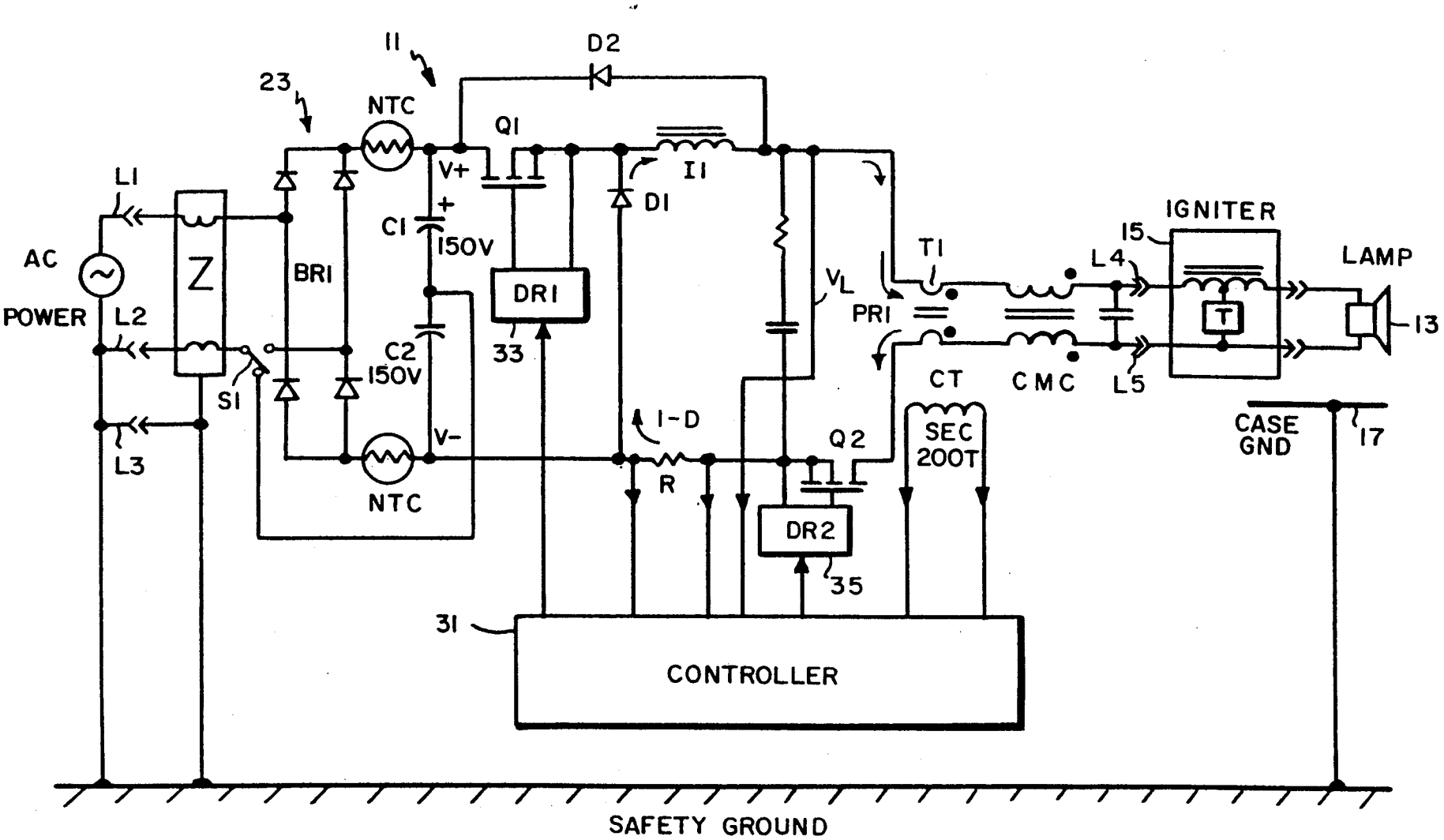
FIG. 1 is a schematic circuit diagram of ballasting apparatus in accordance with the present invention for direct current energization of a gas discharge lamp.

Referring now to FIG. 1, ballasting apparatus according to the present invention is indicated generally by reference character 11. This apparatus is energized from AC supply leads L1–L3 and, as described in greater detail hereinafter, operates to effect controlled energization of a gas-discharge lamp, e.g., as indicated by the reference character 13. The output leads of the ballast apparatus are designated by reference characters L4 and L5 and are connected to the lamp through a typical igniter as indicated by reference character 15. As is usual, the housing or case for the lamp is grounded as indicated at reference character 17.

The AC supply lines are connected, through a line filter 21, to a DC power supply 23 that provides a DC voltage at a level suitable for energizing lamp 13, e.g., 300 volts. The particular power supply circuit illustrated may be operated as either a full-wave bridge or as a voltage doubler so that essentially the same output voltage can be obtained whether the apparatus is operated from 110 volt or 220 volt supply mains. When the switch S1 is in its upper position, the rectifiers in the power supply operate as a full wave bridge (BR1) and when it is in its lower position, the same rectifiers operate as a voltage doubler in conjunction with the filter capacitor C1 and C2.

Pulse-width modulation at relatively high frequency, e.g., as compared with the 60-cycle typical power main frequency, is provided by means of a switching transistor Q1. A controller circuit, designated generally by reference character 31, operates the transistor through a suitable driver circuit indicated by reference character 33. The driver circuit 33, as well as the various other driver circuits referenced hereinafter, provides isolation between the controller and the respective switching transistors which may be operating at line potentials. An inductor I1 is provided in series with the switching transistor Q1 and the inductor and switching transistor are bridged by a diode D2. A normally reverse-biased diode D1 connects the junction between the inductor and the switching transistor to the negative supply lead. As will be understood by those skilled in the art, the inductor I1 will store energy when the transistor Q1 is conducting and will return stored energy when the transistor Q1 is cut off.

A current sensing resistor R1 is provided in the negative supply lead to provide to the controller 31 a signal which represents the current being drawn by the lamp from the supply. As is conventional, the controller 31 operates to vary the duty cycle of the pulse-width modulation in a sense tending to maintain the average current to the lamp at a preselected or desired value. A second transistor switch Q2 is provided in the negative supply lead. As is described in greater detail hereinafter, transistor Q2 is utilized to cut off the current supplied to the lamp at high speed in the event of arcing. Transistor Q2 is operated by controller 31 through suitable driver circuitry 35.

A differential current transformer T1 is provided between the current modulating circuitry and the lamp. The leads to the lamp are arranged as single turn primaries to the transformer T1 and a secondary comprising a much large number of turns, e.g., two hundred, is provided to generate a control signal having an amplitude which is a function of any difference in the currents flowing in the two leads. The control signal is provided to the controller circuitry 31 and, as explained hereinafter, is used to control the switch transistor Q2 in the event of an arc-over.

A common mode choke CMC is interposed between the modulating circuitry and the ignitor 15 and lamp 13. The choke comprises two balanced windings, one for each lead to the lamp, and these windings are oriented so that there is no reactance to balanced currents in the leads but there will be a substantial series inductance opposing any rapid common mode change in the currents flowing through the two leads. By common mode is meant similar changes in the same direction. As is understood, such a common mode or differential current would occur when an arc-over occurs between either of the leads and the case ground 17. The opposing inductance will limit the rate of rise of such an arc-over current.

In that the rate of rise of current occurring on arc-over is limited by the presence of the common mode choke, the controller 31 can operate the switching transistor Q2 so as to cut off the supply of current before damaging current levels are reached or before the arc itself does significant damage.

While the common mode choke and the current transformer have been shown as separate components, which is the presently preferred construction, it should be understood that these two functions can be combined in a single magnetic structure, e.g., by putting a secondary winding comprising a large number of turns on the common mode choke.

While the apparatus of FIG. 1 provides for unidirectional or DC energization of the lamp 13, it should be understood that the present invention can equally be applied to apparatus for effecting AC energization of a lamp. An appropriate arrangement is illustrated in FIG. 2.

As may be seen, the DC supply and pulse-width modulation circuitry are essentially the same as that as illustrated in FIG. 1. The output of the supply and modulation circuitry is, however, connected to the lamp 13 through a full wave switching circuit comprising four switching transistors Q2–Q5. These four switching transistors are operated in pairs by a suitable controller circuit 31, through respective drivers 51–55, so as to effect periodic reversing of the current flow through the lamp of the appropriate frequency.

Figure 2:
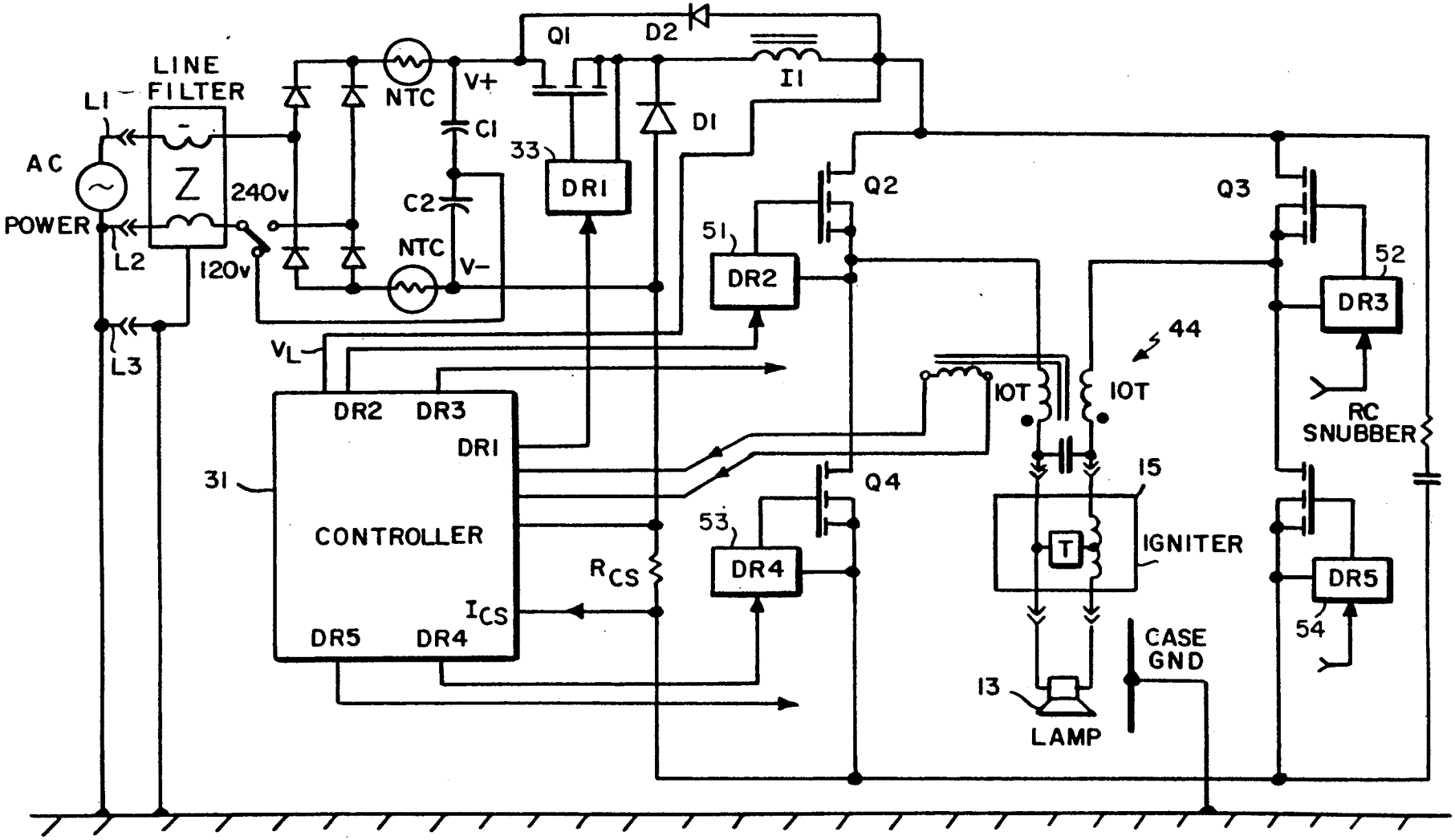
FIG. 2 is a schematic circuit diagram of another embodiment of ballasting apparatus according to the present invention for providing AC energization of a gas-discharge lamp.

In the embodiment of FIG. 2, the functions of the common mode choke and current transformer have been combined, as suggested previously, in a single magnetic structure, designated by reference character 44. Although the currents through the windings of the common mode choke transformer 44 reverse periodically, they remain equal and opposite so that no significant signal voltage is generated in the current sensing secondary which is magnetically linked to the two single turn primary windings, in the absence of an arc over. When an arc over occurs, however, there will be a substantial imbalance of current in the two balanced primary windings and a signal will be developed in a secondary winding. The controller responds to that signal by turning off all four of the switching bridge transistors to Q2–5. Thus, insofar as the present invention is concerned, the operation is essentially the same as that illustrated in FIG. 1 apparatus.

Figure 3:
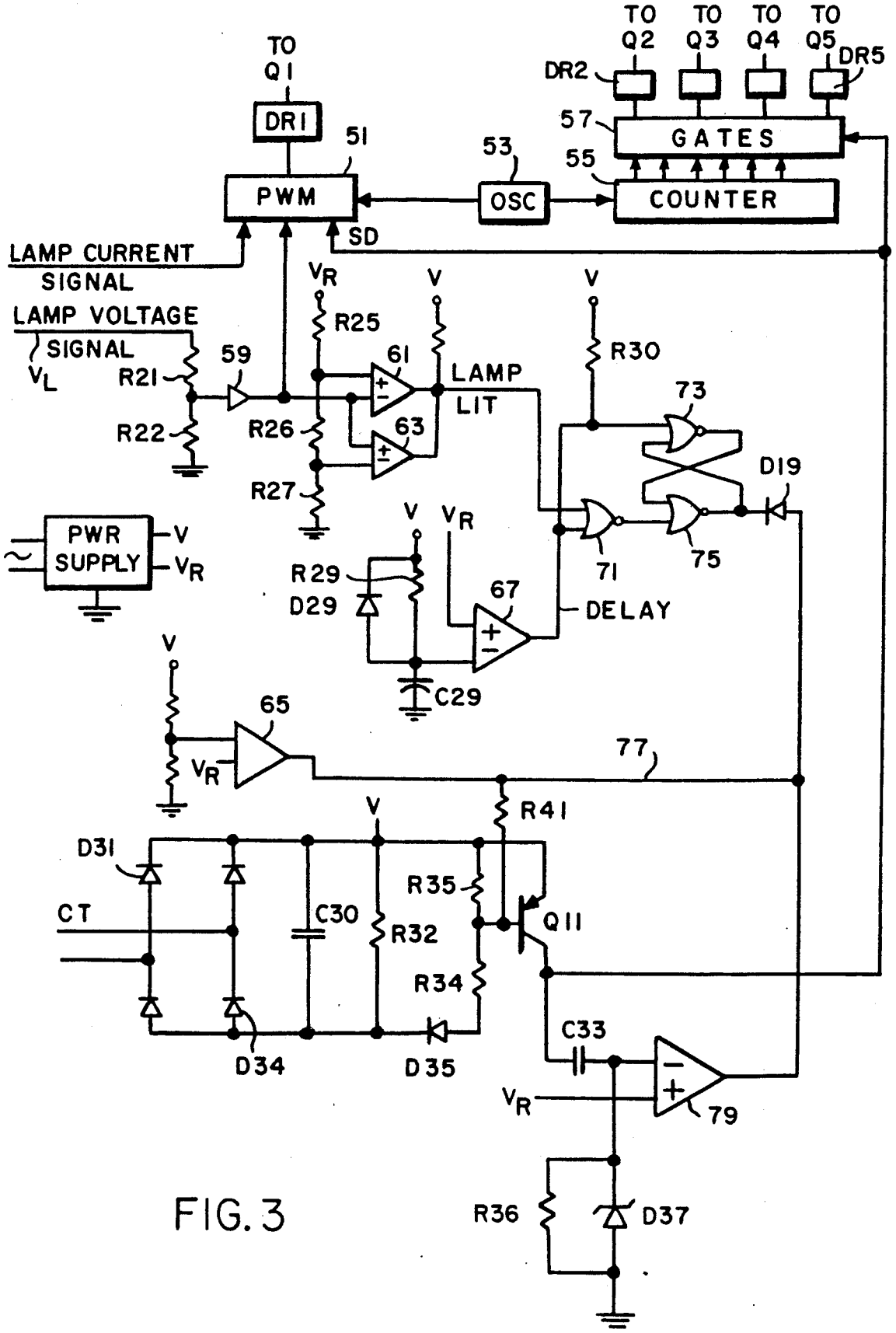
FIG. 3 is a schematic circuit diagram of a controller employed in the apparatus of FIG. 2.

FIG. 3 illustrates controller circuitry appropriate for use with the ballast apparatus of FIG. 2. A will be understood, the controller circuitry for use of the FIG. 1 ballast is essentially a simplified version of the same controller circuitry, some components being eliminated since the lamp is directly energized, rather than through the full wave switch of the FIG. 2 apparatus.

Referring now to FIG. 3, the regulator transistor Q1 of FIG. 2 is energized, through its driver circuitry 33 by a pulse-width modulator circuit 51. The pulse width modulator 51 may, for example, be implemented by means of a commercially available integrated circuit such as the model SG1525A. The pulse repetition rate is established by an oscillator 53 which may, in fact, be part of the same integrated circuit. The pulse width modulator circuit 51 responds to the lamp current signal to vary the pulse width in a sense tending to maintain the desired level of current through the lamp. The pulse width modulator circuit 51 also includes an input terminal for a shut down or halt signal which overrides the existing state of the modulator and turns off the transistor Q1. The shut down signal is derived, as explained in greater detail hereinafter.

Oscillator 53 also drives a multi-stage counter 55 which, through an array of gates 57, controls the energization of the full-wave switching transistors Q2–Q5. Gating circuitry 57 essentially implements combinatorial logic which causes the full wave switch transistors Q2–Q5 to be energized in combinations in the appropriate sequence as described previously. Counter circuitry 55 also includes an input terminal for the shut down signal and when that signal is applied, all of the transistors Q2–Q5 are turned off.

The lamp voltage signal is applied, through a high impedance resistive divider comprising resistors R21 and R22 and a buffer amplifier 59, to the inverting and non-inverting inputs respectively of a pair of comparators 61 and 63. Suitable reference voltages ar applied to the other input of each of the comparators by means of a voltage divider comprising resistors R25–R27. The comparators 61 and 63 have open collector outputs and these output terminals are wired together in a "wired OR" configuration so as to provide an output signal which goes low (high) when the lamp voltage signal is between the two reference levels. These reference levels are selected to correspond with a normal operating range for the particular lamp which is to be energized and the combined output signal is designated the "LAMP LIT" signal.

The unregulated power supply voltage is monitored by a comparator 65 to determine whether appropriate input power is available to the controller circuitry. The output from comparator 65 is directly applied to the line 77 so a to initiate a shut down of the ballast if input power fails. The power supply voltage is also employed to effect the charging of a timing circuit comprising resistor R29 and capacitor C29 which established an initial period for lamp starting. The voltage on capacitor C29 is monitored by a comparator 67 to generate an output signal, designated "DELAY". The DELAY signal is asserted about two seconds after the system is initially powered up. The DELAY and the LAMP LIT signals are combined in a NOR gate 71, the output of which is applied to one side of a flip-flop comprising a pair of NOR gates 73 and 75. If the LAMP LIT signal does not go true within the delay, the flip-flop asserts, through a diode D19, an intermediate shutdown signal through a common shutdown line designated by reference character 77.

The a.c. signal from the common mode transformer 44 is rectified by full wave bridge rectifiers 31–34; filtered by capacitor C30 and applied across a load resistor R32 to generate a d.c. voltage indicative of any imbalance current in the leads to the lamp. This voltage is applied, through a diode D35 and a resistive divider R34 and R35, to forward bias a PNP transistor Q11 when the imbalance current exceeds a preselectable threshold. Transistor Q11 can also be forward biased directly by the intermediate shutdown signal on line 77 applied to the base of transistor Q11 through a resistor R41.

The collector signal from transistor Q11 is applied as the actual shutdown signal to the pulse width modulator 51 and the drive gates 57. To prevent any high frequency switching or chatter between on and off states, the collector signal from transistor Q11 is also a.c. coupled, through a capacitor C33, to one input of a comparator 79, clipping and biasing being provided by a Schottky diode D36 and a resistor R36 respectively. The open collector output from the comparator 79 is applied to the common intermediate signal line 77 so that, any time the shutdown signal is activated, it is held in that state for a fixed amount of time, e.g., about 25 milliseconds.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. Apparatus for operating a lamp of a type in which a discharge is energized through a pair of leads and which requires ballasting, said apparatus comprising:

supply means for generating a d.c. voltage at a level suitable for energizing the lamp;

means including a series semiconductor switch and an inductor for maintaining current flow when said switch is off for pulse width modulating at relatively high frequency the current flow to the lamp from said supply means as a function of the current drawn by said lamp;

a common mode choke between said supply and the lamp, said choke having a pair of matched windings connected to said leads to provide a series inductance opposing rapid common mode changes in the currents flowing through said leads;

a differential transformer including a winding inductively linked to the currents flowing in said leads for generating a control signal having an amplitude which is a function of any difference in the currents flowing in said leads;

semiconductor switch means interposed between said inductor and the lamp for selectively interrupting current flow to the lamp; and control means responsive to said control signal for opening said interrupting switch means when the current difference in said leads rises above a preselectable level indicating an arcing condition.

2. Apparatus as set forth in claim 1 wherein said control signal generating winding is inductively coupled to the matched windings in said common mode choke.

3. Apparatus as set forth in claim 1 wherein said interrupting switch is a transistor.

4. Apparatus as set forth in claim 1 including a switching bridge for periodically reversing the current through the lamp from the supply means thereby to effect a.c. energization of the lamp.

5. Apparatus as set forth in claim 4 wherein said switching bridge comprises a plurality of transistors all of which are turned off to interrupt current flow to the lamp.

6. Apparatus as set forth in claim 1 wherein said supply means comprises an array of rectifiers and capacitors configurable as either a full wave bridge or a voltage doubler whereby said supply means can be energized from a.c. supply mains of two different voltages.

7. Apparatus for operating a lamp of a type in which a discharge is energized through a pair of leads and which requires ballasting, said apparatus comprising:

supply means for generating a d.c. voltage at a level suitable for energizing the lamp;

means including a series semiconductor switch and an inductor for maintaining current flow when said switch is off for pulse width modulating at relatively high frequency the current flow to the lamp from said supply means as a function of the current drawn by said lamp;

a common mode choke between said supply and the lamp, said choke having a pair of matched windings connected to said leads to provide a series inductance opposing rapid common mode changes in the currents flowing through said leads;

means including a winding inductively linked to the matched windings in said common mode choke for generating a control signal having an amplitude which is a function of any difference in the currents flowing in said leads;

a switching bridge interposed between said inductor and the lamp and comprising a plurality of transistors for periodically reversing the current through the lamp from the supply means; and control means responsive to said control signal for turning off said bridge transistors when the current difference in said leads rises above a preselectable level indicating an arcing condition.

* * * * *